US011352168B2

(12) United States Patent
Green et al.

(10) Patent No.: US 11,352,168 B2
(45) Date of Patent: Jun. 7, 2022

(54) COLLAPSIBLE CRATE

(71) Applicant: U.S. Merchants Financial Group, Inc., Beverly Hills, CA (US)

(72) Inventors: Jeff Green, Beverly Hills, CA (US); Jose F. Gomez-Mustafa, Beverly Hills, CA (US)

(73) Assignee: U.S. Merchants Financial Group, Inc., Beverly Hills, CA (US)

( * ) Notice: Subject to any disclaimer, the term of this patent is extended or adjusted under 35 U.S.C. 154(b) by 480 days.

(21) Appl. No.: 14/746,770

(22) Filed: Jun. 22, 2015

(65) Prior Publication Data

US 2016/0368656 A1 Dec. 22, 2016

(51) Int. Cl.
*B65D 6/16* (2006.01)
*B65D 6/18* (2006.01)

(52) U.S. Cl.
CPC ..... *B65D 11/18* (2013.01); *B65D 11/1826* (2013.01)

(58) Field of Classification Search
CPC . B65D 11/18; B65D 11/1833; B65D 11/1826; B65D 11/182; B65D 11/1813; B65D 11/1806; B65D 11/1873
USPC ..... 206/425; 220/6, 7
See application file for complete search history.

(56) References Cited

U.S. PATENT DOCUMENTS 2,972,430 A 2/1961 Johnson
3,424,365 A * 1/1969 Emilio ..... F16B 5/0607 220/7
3,556,339 A 1/1971 Lind et al.
3,675,808 A * 7/1972 Brink ..... B65D 1/225 220/7
3,796,342 A 3/1974 Sanders et al.
3,896,962 A 7/1975 Smith
(Continued)

FOREIGN PATENT DOCUMENTS

EP 1609725 12/2005
GB 2362635 11/2001

OTHER PUBLICATIONS

SSI Schaefer, For the Best Return Schaefer Collapsible Containers, product catalog pages available at http://www.ssi-schaefer.us/fileadmin/ssi/images/us/Stor-Dist/bins-cont/CF_Collapsible_Containers.pdf 2 pages, printed Jul. 30, 2015.
(Continued)

*Primary Examiner* — Robert Poon
(74) *Attorney, Agent, or Firm* — Lewis Roca Rothgerber Christie LLP

(57) ABSTRACT

A collapsible crate with improved stability and smooth movement includes a top having two opposing top side sections defining top side axes and two opposing top end sections defining top end axes; a bottom having two opposing bottom side edges defining bottom side axes and two opposing bottom end edges defining bottom end axes; first and second opposing end walls, the first and second end walls each being pivotably connected to the top along the corresponding top end sections with interlocking projections; and first and second opposing side walls. The crate includes one or more features which help the crate remain in the erect configuration, for example, a first protrusion protruding from an inner surface of a first side wall, wherein the first protrusion is configured to abut with a portion of a first end wall with an interference fit when the crate is in an erect configuration.

13 Claims, 18 Drawing Sheets

(56) References Cited

U.S. PATENT DOCUMENTS

| | | | | | |
|---|---|---|---|---|---|
| 4,044,910 | A * | 8/1977 | Box | B65D 11/1833 | 220/7 |
| 4,508,237 | A | 4/1985 | Kreeger et al. | | |
| 4,684,034 | A | 8/1987 | Ono et al. | | |
| 4,693,387 | A | 9/1987 | Stonier | | |
| 4,775,069 | A | 10/1988 | Stonier | | |
| 4,798,304 | A | 1/1989 | Rader | | |
| D302,897 | S | 8/1989 | Shchamorov et al. | | |
| 4,913,302 | A | 4/1990 | Stonier | | |
| 4,960,223 | A * | 10/1990 | Chiang | B65D 11/1833 | 220/6 |
| 5,038,953 | A * | 8/1991 | Radar | B42F 15/0094 | 220/6 |
| 5,190,152 | A | 3/1993 | Smith et al. | | |
| 5,253,763 | A | 10/1993 | Kirkley et al. | | |
| 5,323,921 | A | 6/1994 | Olsson | | |
| D355,073 | S | 2/1995 | Junaedi | | |
| 5,515,987 | A * | 5/1996 | Jacques | B65D 11/1833 | 220/6 |
| 5,538,153 | A * | 7/1996 | Marovskis | B65D 11/1873 | 220/6 |
| 5,588,549 | A * | 12/1996 | Furtner | B65D 11/1833 | 220/7 |
| 5,671,858 | A * | 9/1997 | Hsu | B65D 11/18 | 220/9.2 |
| 5,746,342 | A * | 5/1998 | Jacques | B65D 1/246 | 220/6 |
| 5,842,570 | A * | 12/1998 | Turnbull | B42F 15/0094 | 206/425 |
| 6,152,318 | A | 11/2000 | Walker | | |
| 6,193,340 | B1 | 2/2001 | Schenker et al. | | |
| 6,299,011 | B1 | 10/2001 | Rosenfeldt | | |
| 6,405,888 | B1 | 6/2002 | Overholt et al. | | |
| 6,446,825 | B1 * | 9/2002 | Godoy | B65D 11/1833 | 220/1.5 |
| 6,616,003 | B1 | 9/2003 | Polenta | | |
| 6,868,979 | B2 | 3/2005 | Rader | | |
| 6,913,161 | B2 | 7/2005 | Schäfer | | |
| 6,918,502 | B1 | 7/2005 | Overholt et al. | | |
| 7,017,766 | B2 | 3/2006 | Hsu et al. | | |
| 7,048,135 | B2 | 5/2006 | Smyers et al. | | |
| 7,059,489 | B2 | 6/2006 | Apps et al. | | |
| 7,083,061 | B2 | 8/2006 | Spindel et al. | | |
| 7,104,414 | B2 | 9/2006 | Apps et al. | | |
| 7,137,522 | B2 | 11/2006 | Dubois | | |
| 7,159,730 | B2 * | 1/2007 | Rumpel | B65D 11/1833 | 220/23.6 |
| 7,175,040 | B2 | 2/2007 | Lorenz et al. | | |
| 7,195,127 | B2 | 3/2007 | Hsu et al. | | |
| 7,290,663 | B2 | 11/2007 | Deng et al. | | |
| 7,370,771 | B2 | 5/2008 | Rader | | |
| 7,478,726 | B2 | 1/2009 | Apps et al. | | |
| 7,549,550 | B2 | 6/2009 | Smyers et al. | | |
| 7,556,165 | B2 | 7/2009 | McDade | | |
| 7,717,283 | B2 | 5/2010 | Apps et al. | | |
| 7,784,632 | B2 | 8/2010 | Truong | | |
| 7,861,458 | B2 | 1/2011 | Apps et al. | | |
| 7,861,878 | B2 * | 1/2011 | Escarpa Gil | B65D 11/1833 | 220/7 |
| 7,861,879 | B2 | 1/2011 | Samprathi | | |
| 7,921,998 | B2 | 4/2011 | Schenker | | |
| 8,011,523 | B2 | 9/2011 | Kochanowski | | |
| 8,205,763 | B2 | 6/2012 | Fredrickson | | |
| 8,267,270 | B2 | 9/2012 | Samprathi | | |
| 8,308,018 | B2 | 11/2012 | Kochanowski | | |
| 8,342,347 | B2 | 1/2013 | Hay | | |
| 8,348,076 | B2 | 1/2013 | Rader et al. | | |
| 8,485,376 | B2 | 7/2013 | Samprathi | | |
| 8,573,433 | B2 | 11/2013 | Kochanowski | | |
| 8,640,912 | B2 | 2/2014 | Orgeldinger | | |
| 8,757,412 | B2 | 6/2014 | Sommer et al. | | |
| 8,870,008 | B2 | 10/2014 | Wu et al. | | |
| 8,875,924 | B2 | 11/2014 | Orgeldinger | | |
| 9,371,154 | B2 | 6/2016 | Samprathi | | |
| D801,686 | S | 11/2017 | Park | | |
| 10,065,763 | B2 | 9/2018 | Wilcox | | |
| 2002/0108951 | A1 * | 8/2002 | Zelko | B65D 11/1833 | 220/7 |
| 2003/0006232 | A1 * | 1/2003 | Raghunathan | B65D 11/1833 | 220/7 |
| 2003/0116564 | A1 * | 6/2003 | Overholt | B65D 11/1833 | 220/7 |
| 2004/0226945 | A1 * | 11/2004 | Hsu | B65D 11/1833 | 220/6 |
| 2006/0231555 | A1 * | 10/2006 | Smyers | B65D 11/1833 | 220/6 |
| 2007/0095825 | A1 | 5/2007 | Tsao | | |
| 2007/0210083 | A1 | 9/2007 | Li | | |
| 2007/0278223 | A1 | 12/2007 | Ficker | | |
| 2008/0116201 | A1 | 5/2008 | Baltz | | |
| 2009/0000975 | A1 | 1/2009 | Schenker | | |
| 2009/0114645 | A1 * | 5/2009 | Zemer | B65D 11/1873 | 220/1.5 |
| 2009/0159593 | A1 * | 6/2009 | Apps | B65D 11/1833 | 220/7 |
| 2015/0014310 | A1 | 1/2015 | Liu et al. | | |
| 2015/0028027 | A1 | 1/2015 | Cavalcante et al. | | |
| 2015/0060442 | A1 | 3/2015 | Liu et al. | | |
| 2015/0375558 | A1 | 12/2015 | Ben-Or | | |
| 2016/0368656 | A1 | 12/2016 | Green et al. | | |
| 2017/0137175 | A1 | 5/2017 | Park | | |
| 2017/0297362 | A1 | 10/2017 | Bauer et al. | | |

OTHER PUBLICATIONS

ORBIS FC2415-089 product webpage available at http://www.orbiscorporation.com/Products/Hand-Held-Containers/Collapsible/FC2415-089#.VbloYvIVhBc 1 page, printed Jul. 30, 2015.

Today's the Best Day Making Every Day the Best Day for Your Marriage and Your Family, Clever Crates—Review and Giveaway, dated Mar. 19, 2015, found at http://www.todaysthebestday.com/clever-crates-review-giveaway, 4 pages.

Canadian Office action for Application No. 2,918,113, dated Mar. 9, 2017, 3 pages.

Canadian Office action for Application No. 3,031,637, dated Jan. 15, 2020, 4 pages.

Canadian Office action for Application No. 3,031,637, dated Jun. 22, 2020, 4 pages.

* cited by examiner

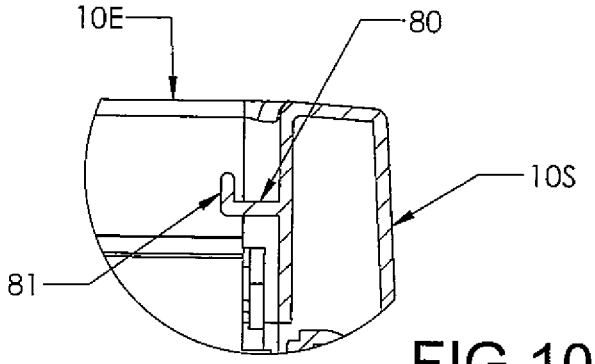
FIG.10C
FIG.11
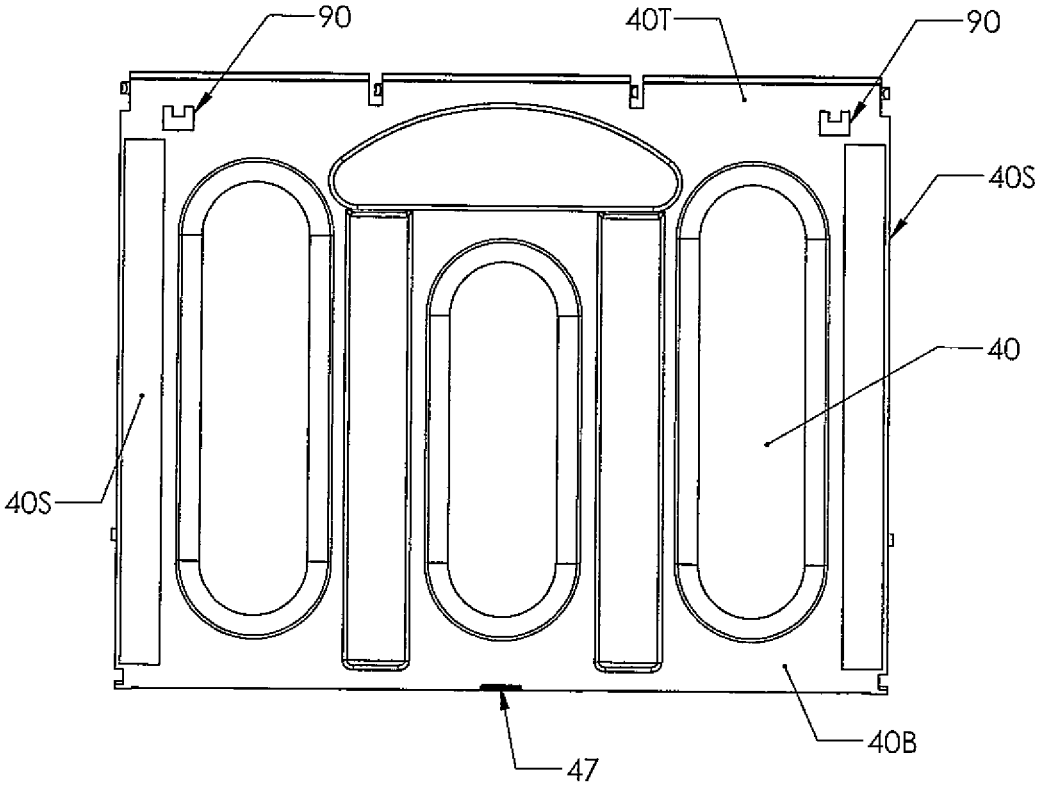

COLLAPSIBLE CRATE

BACKGROUND

1. Field

The present disclosure relates generally to the field of storage boxes, and more particularly to a collapsible storage box (or crate or container, all used interchangeably herein).

2. Description of the Related Art

Crates or containers for storing objects are well known. Collapsible crates that may be adjusted between a collapsed (or substantially flat) position and an erect (or substantially upright) position provide a user with the ability to store objects when needed and to reduce the area required to store an empty crate, for example, a crate that is not in use. However, many existing collapsible rates may be heavy, costly and/or difficult to manufacture, and may employ complicated mechanisms that keep the crate in an erect position. Stability and swift assembly and disassembly are desirable features in a collapsible crate.

SUMMARY

The present disclosure is directed to a collapsible crate with improved stability and smoother movement and can be assembled and disassembled quickly with ease. The crate can withstand greater load both in terms of stackability and interior load carrying ability.

In some embodiments, a collapsible crate includes an open frame top member having two opposing top side sections and two opposing top end sections, and a planar bottom member having two opposing bottom side edges and two opposing bottom end edges. The collapsible crate also has a first and second opposing side walls and first and second opposing end walls, each standing between the top and bottom members when the crate is erect. To enable transition of the crate between an erect and a collapsed configuration, each end wall is pivotably connected along its top edge to a respective top end section with interlocking projections that enable each end wall to swing or pivot between a standing position and an angled position. Each side wall is pivotably connected along its top edge to a respective top side section and along its bottom edge to a respective bottom side edge with top and bottom interlocking projections that enable each side wall to transition between a standing position and an angled position. In that regard, each side wall includes a hinge that divides each side wall into an upper panel and a lower panel and enables the upper and lower panels to fold inwardly and flatten against each other in collapsing the crate.

The crate includes one or more selected features to help stabilize the crate to remain in the erect configuration. In some embodiments, at least one side wall has at least one interference protrusion configured for abutment or interference contact with a standing end wall that requires a user collapsing the crate to apply a threshold inward force to release or dislodge the end wall from its standing position. In some embodiments, a releasable catch is configured between a bottom edge of an end wall and an end edge of the bottom member which also requires the user collapsing the crate to apply a threshold inward force to release the end wall from its standing position. In that regard, some embodiments include one or more alignment guide tabs configured between the bottom edge of the end wall and the end edge of the bottom member to help align the end wall with the bottom member as the end wall pivots toward its standing position. The guide tabs also help the end wall remain aligned while in the standing position.

The crate also includes one or more features to help stabilize the crate, especially when a stacking and/or carrying load is imposed on the crate. In some embodiments, a stop tab is provided on an inner surface of at least one hinge, for example, near an edge of the side wall, to minimize the risk of the hinge buckling outwardly and destabilizing the crate. In some embodiments, one or more flanges extend from an edge of at least one side wall to at least maintain and/or contact an edge of at least one adjacent end wall when the crate is erect. The one or more flanges help keep the end wall from swinging outwardly and destabilizing the crate.

The crate further includes one or more features to guide movement of one or more end walls between their standing and angled positions as the crate transits between its erect and collapsed configurations. In some embodiments, one or more side wall includes at least one recessed channel on their inner surface, and one or more adjacent end walls include a projecting pin on their side edges that rides in the channel. These features not only minimize the risk of the inner surface being damaged by scratches or marring that may otherwise result from rubbing contact between the side edges of end walls and the inner surface of the side walls, but they also provide a smoother movement of the end walls when the crate transitions between the collapsed and erect configurations.

In some embodiments, the crate includes a pair of grooves or rails configured along opposing inner surfaces of the frame top member, the rails being adapted to receive hooks of hanging file folders housed in the crate. In some embodiments, the crate includes brackets configured in corner regions of opposing inner surfaces of the frame top member, the brackets being adapted to receive ends of elongated support members, e.g., rods or bars, on which hanging file folders may be hung.

BRIEF DESCRIPTION OF THE DRAWINGS

These and other features and aspects of embodiments of the present disclosure will be better understood by reference to the following detailed description, when considered in conjunction with the accompanying drawings. The same numbers are used throughout the figures to reference like features and components.

FIG. 10C is a detailed end cross-sectional view of a rail of FIG. 10B, as shown in region M.

FIG. 11 is a front view of an inner surface of an end wall, in accordance with an embodiment.

DETAILED DESCRIPTION

The present disclosure is directed to a collapsible crate (or box or container, all used interchangeably herein). The figures depict some example embodiments as applied to a collapsible crate for illustrative purposes only, and it will be apparent that modifications may be made without departing from the spirit and scope of the invention, and also that the present disclosure may be used in other applications in the same or similar fields. Although relative terms such as "first," "second," "third," "fourth," "top," "bottom," "right," "left," "length," "width," "depth," "standing," "erect," "vertical," " horizontal," and similar terms have been used herein to describe relative spatial relationships between elements and/or orientation, it is to be understood that these terms are intended to encompass different orientations of the various elements and components of the device in addition to the orientation depicted in the figures. Moreover, the figures contained in this application are not necessarily to scale.

Figure 1:
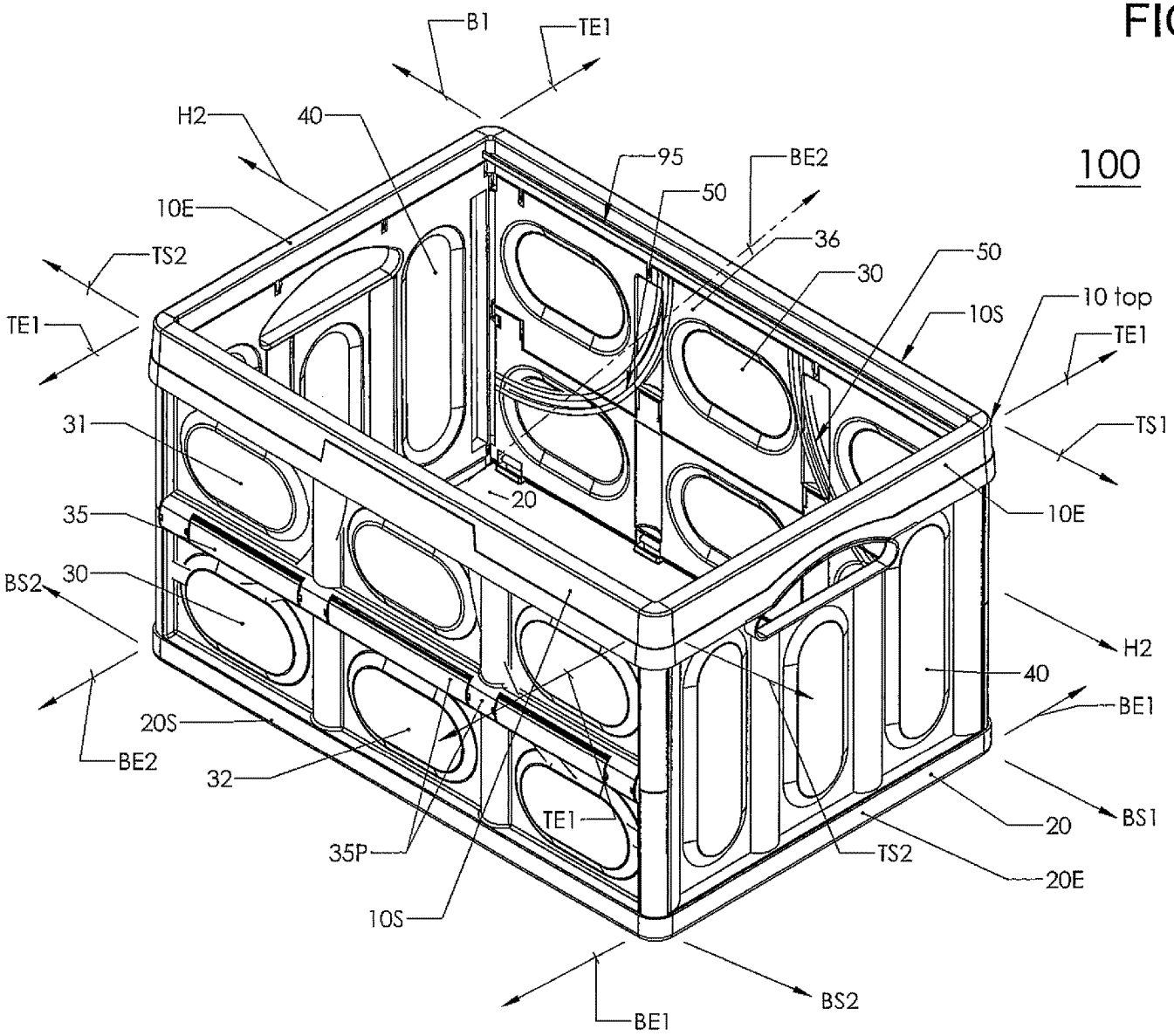
FIG. 1 is a perspective view of a collapsible crate in an erect configuration according to one or more embodiments of the present disclosure.
Figure 2:
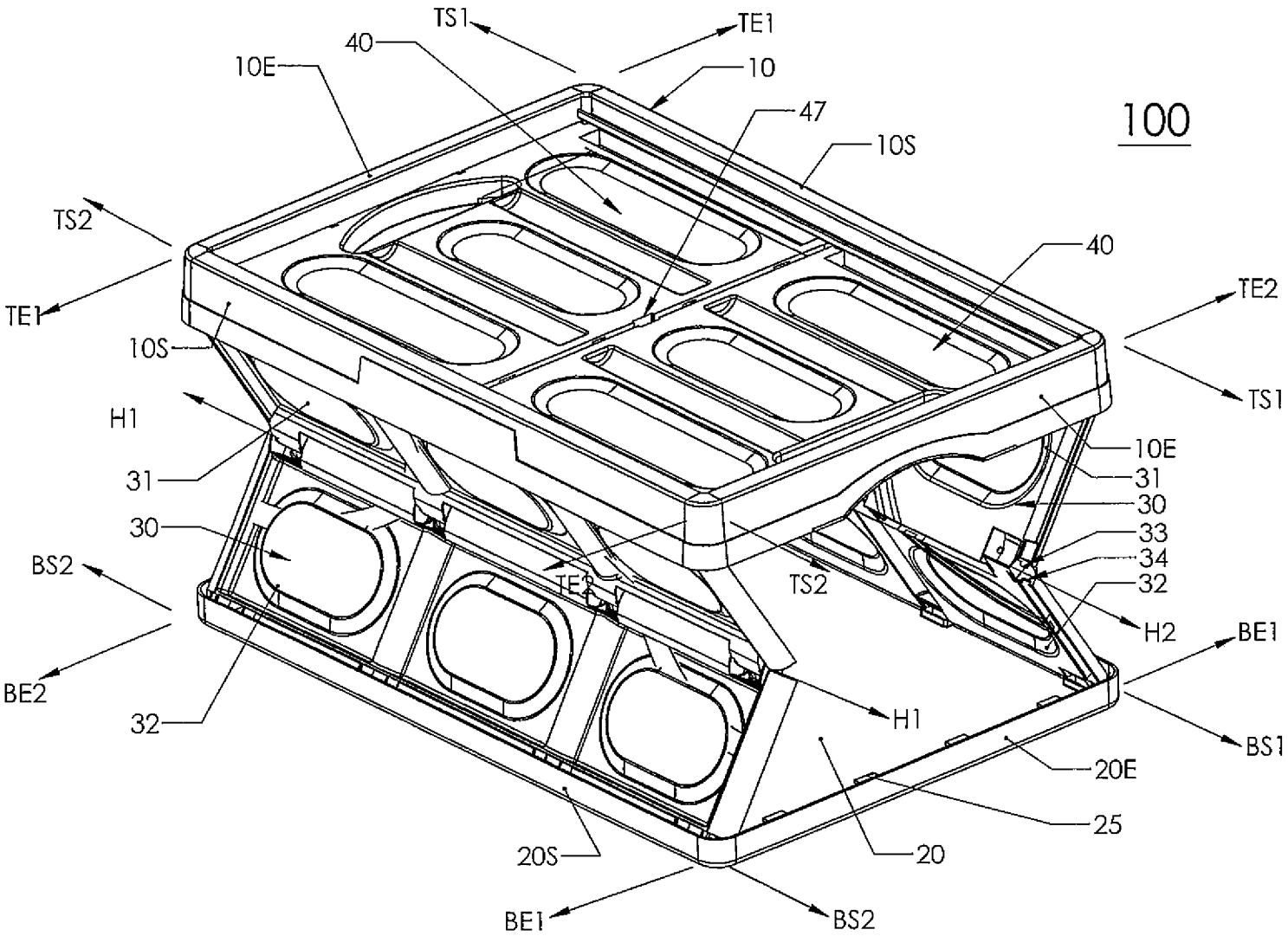
FIG. 2 is a perspective view of the crate of FIG. 1 in an intermediate configuration between erect and collapsed configurations.

Referring now to FIGS. 1-4, a collapsible crate 100 in some embodiments includes a top member 10, a bottom member 20, two side walls 30 and two end walls 40. The collapsible crate is movable between an erect configuration, illustrated in FIG. 1, and a collapsed configuration, illustrated in FIG. 3. When the crate is in the erect configuration, the two side walls 30 are opposing each other and the two end walls 40 are opposing each other, with both side walls 30 and both end walls 40 standing or vertically upright. When the crate is in the collapsed configuration, the side walls 30 and end walls 40 are generally lying on the bottom member 20. Transition between the two configurations are enabled by movable and/or hinged components, where the end walls 40 are pivoted inwardly against an underside of the top member 10, and the side walls 30 are folded inwardly between the end walls 40 and the bottom member 20, as shown in FIG. 2.

With reference to FIG. 1, the top member 10 may be a rectangular frame, for example, an open frame with two opposing top side sections 10S defining top side axes TS1 and TS2, and two opposing top end sections 10E defining top end axes TE1 and TE2 generally perpendicular to the axes TS1 and TS2. The side sections 10S and end sections 10E of the top member 10 jointly frame an opening through which the interior of the crate is accessed. The bottom member 20 has a planar panel body that is vertically aligned with the top member 10 and has two opposing bottom side edges 20S and two opposing bottom end edges 20E that define bottom side axes BS1 and BS2, and bottom end axes BE1 and BE2, respectively.

Figure 4A:
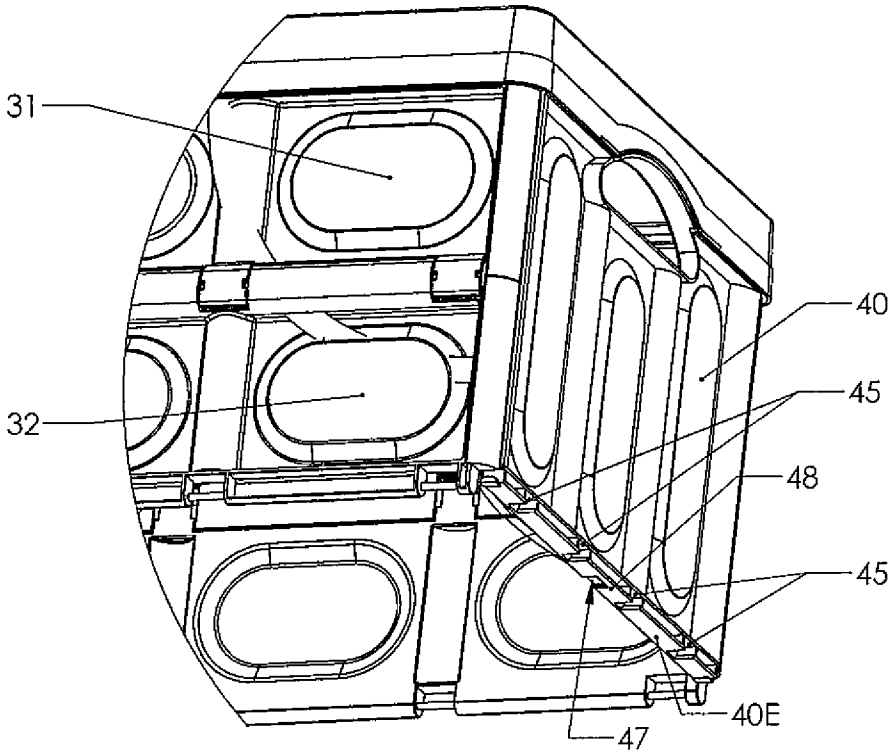
FIG. 4A is a partial perspective view of the crate with a bottom member removed for clarity.
Figure 4B:
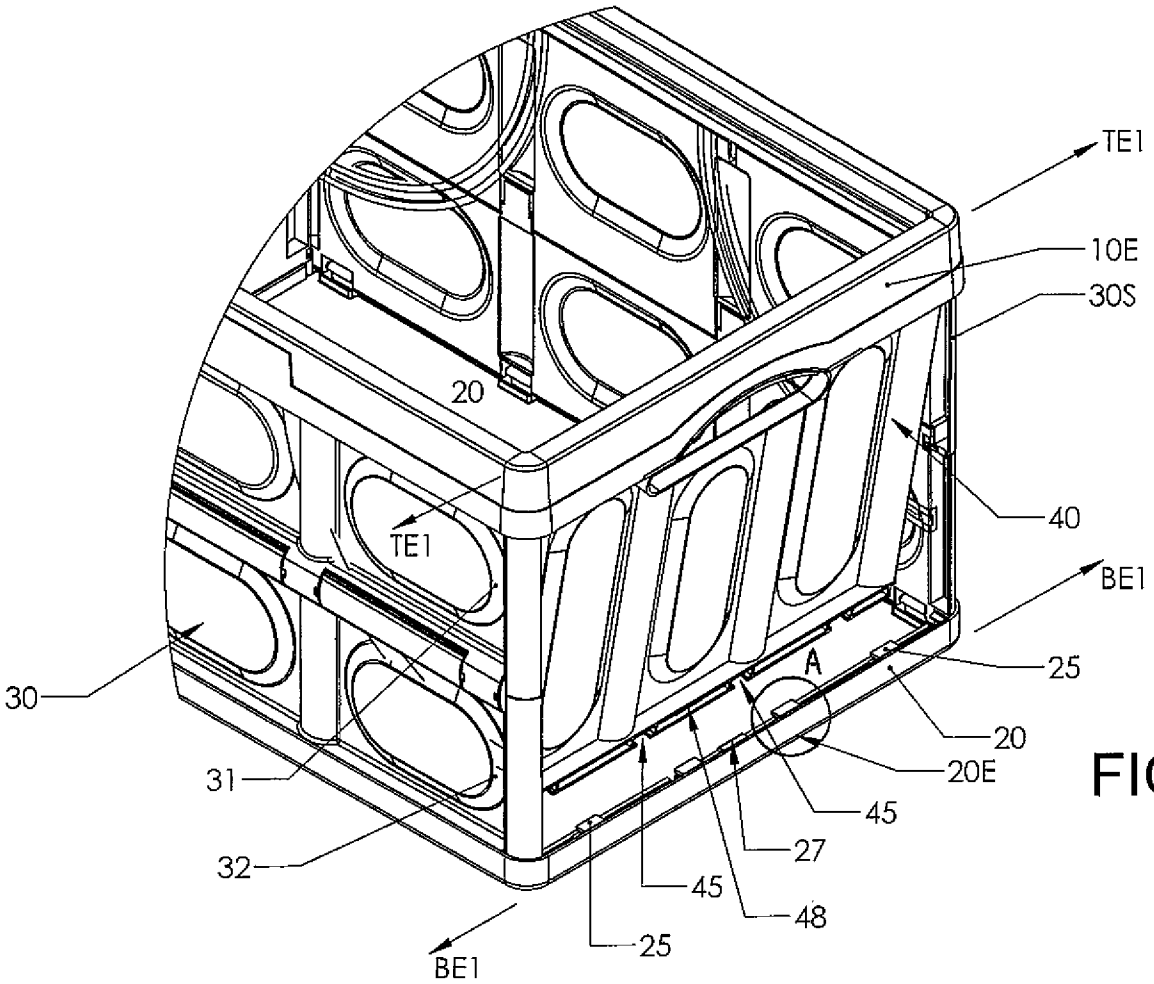
FIG. 4B is a partial perspective view of the crate of FIG. 1 with an end panel slightly displaced from a standing position.

Each end wall 40 has a single-piece, planar construction and is pivotally (or pivotably) connected along its upper edge (e.g., a top edge 40T) to the top end sections 10E with interlocking projections. The interlocking projections enable the end walls 40 to pivot or swing inwardly about the top end axis TE1 or TE2 such that a bottom edge 40B of the end walls 40 can move away and inwardly from the bottom end edges 20E of the bottom 20, as shown in FIG. 4B.

Each side wall 30 includes an upper panel 31 and a lower panel 32 that are pivotally connected to each other, e.g., by a hinge 35, defining side axes H1 and H2, as shown in FIG. 2. In some embodiments, the hinge 35 includes interlocking projections 35P extending from a lower edge of the upper panel 31 and an upper edge of the lower panel 32 and the hinge 35 may be configured to divide the upper and lower panels 31 and 32 into an equal size. The interlocking projections 35P are configured to enable the upper and lower panels to fold inwardly along the hinge.

In some embodiments, the upper panel 31 and the lower panel 32 have a similar shape and size. For example, the upper panel 31 may have a height that is generally equal to a height of the lower panel 32, such that the hinge 35 generally corresponds to the horizontal mid-line of the side walls 30. The upper panels 31 are pivotally connected along their top edges 30T to the top side section 10S with interlocking projections, and the lower panels 32 are pivotally connected along their bottom edges 30B to the bottom side edge 20S with interlocking projections. These upper and lower interlocking projections along with the hinge 35 are configured to enable the upper and lower panels 31 and 32 to pivot inwardly, as illustrated in FIG. 2.

Figure 3:
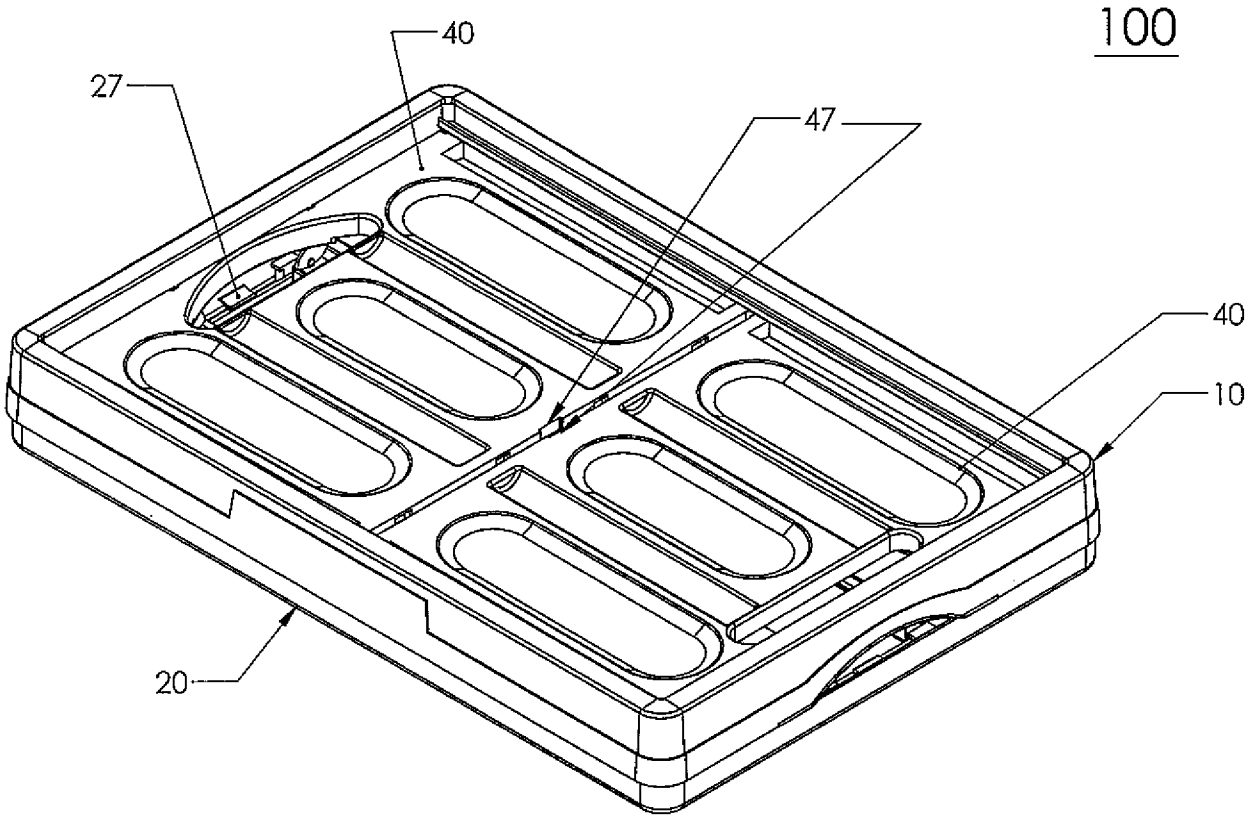
FIG. 3 is a perspective view of the crate of FIG. 1 in a collapsed configuration.

As such, the end walls 40 may pivot inwardly with respect to the top 10 about the top end axis TE1 or TE2 (FIG. 4B), and the upper and lower panels 31 and 32 may pivot inwardly with respect to each other about the corresponding side axis H1 or H2, and with respect to the top 10 and the bottom 20, respectively, about the top side axis TS1 or TS2, and about the bottom side axis BS1 or BS2 (FIG. 2), to enable the crate to fold from the erect position of FIG. 1 into the collapsed position (FIG. 3).

When the crate 100 is in the collapsed configuration, the side walls 30 collapse, fold inwardly and rest above the bottom 20 member. For example, the upper panel 31 and lower panel 32 are folded about the hinge 35 and the side axis H1 or H2 such that they are lying generally flat against each other with the upper panel 31 resting above the lower panel 32 and the lower panel 32 resting above the bottom member 20. The end walls 40 are each lying generally flat, resting above the side walls 30, as illustrated in FIG. 3.

To rearrange or change the crate 100 from the collapsed configuration to the erect configuration, a user may grip the top member 10, e.g., via a handle opening formed in each end wall 40 near the top member 10, and pull the top member 10 away from the bottom member 20 (i.e., a direction perpendicular to the top end axes TE1 and TE2 and the top side axes TS1 and TS2). As the top member 10 moves away from the bottom member 20, the upper panels 31 and the lower panels 32 pivot about the side axes H1 or H2, as the top edges 30T of the side walls 30 pivot about the corresponding top side axes TS1 or TS2 and as the bottom edges 30T of the side walls 30 pivot about the corresponding bottom side axes BS1 or BS2. After the side walls 30 are standing, the end walls 40 may drop under their own weight or be aided by the user to pivot about the top end axes TE1 or TE2 toward the bottom 20 so that the end walls 40 are also standing.

To change the crate 100 from the erect configuration to the collapsed configuration, the user may apply an inward force to the end walls 40 so that the end walls 40 pivot about the top end axes TE1 or TE2 to swing upwardly away from the bottom 20. The upper panels 31 and the lower panels 32 can then collapse by pivoting about the side axes H1 or H2, and about the corresponding top side axes TS1 or TS2 and the corresponding bottom side axes BS1 or BS2, respectively. As the upper panels 31 and the lower panels 32 fold inwardly, the top 10 moves downwardly toward the bottom 20.

Figure 5B:
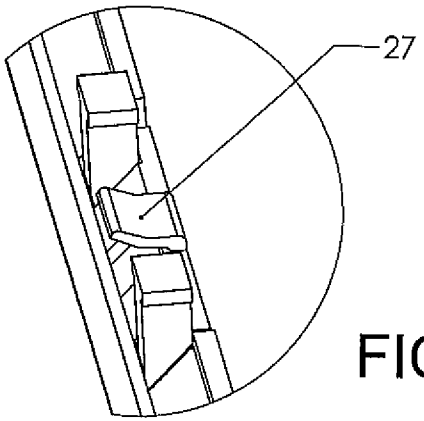
FIG. 5B is a detailed view of a releasable catch of FIG. 4B, in region A.
Figure 5A:
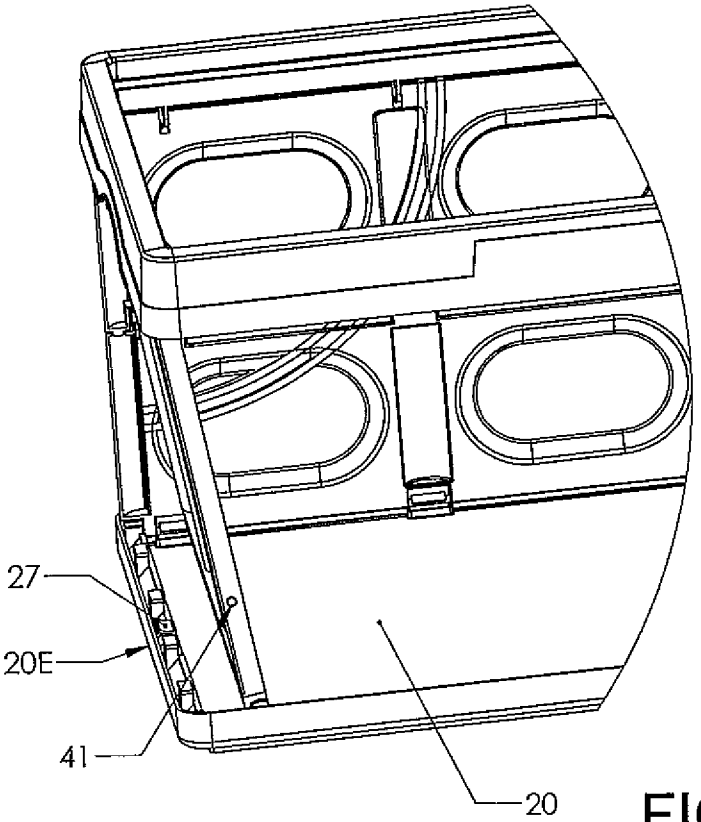
FIG. 5A is a partial perspective view of the crate of FIG. 4B, with a side panel removed for clarity.
Figure 5C:
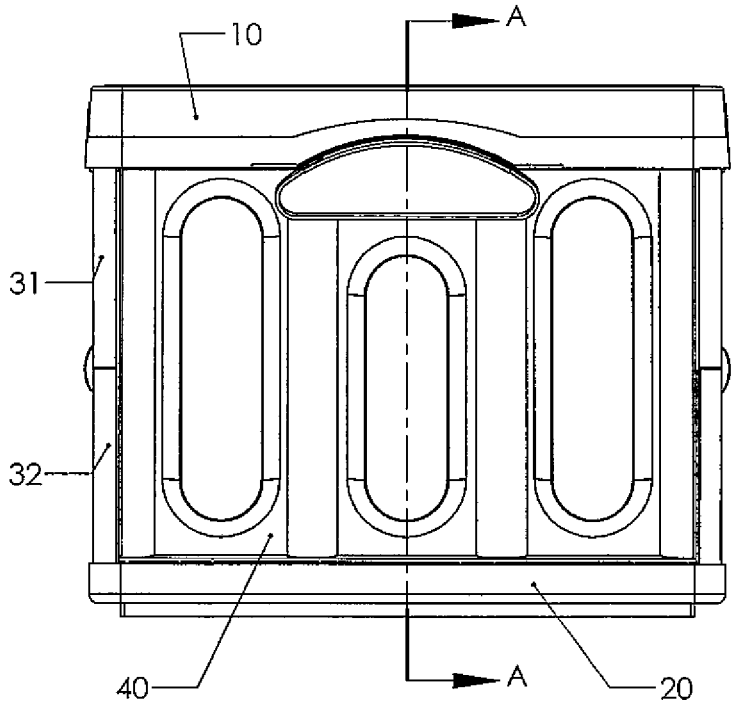
FIG. 5C is an end view of the crate of FIG. 1, with an end panel slightly displaced from a standing position.
Figure 5E:
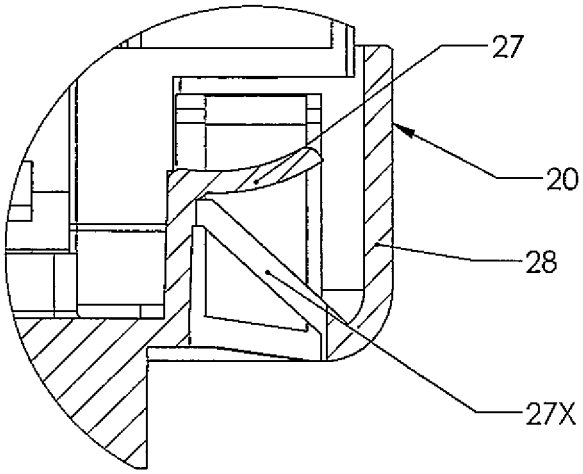
FIG. 5E is a detailed side cross-sectional view of a releasable catch of FIG. 5D, as shown in region C.
Figure 5D:
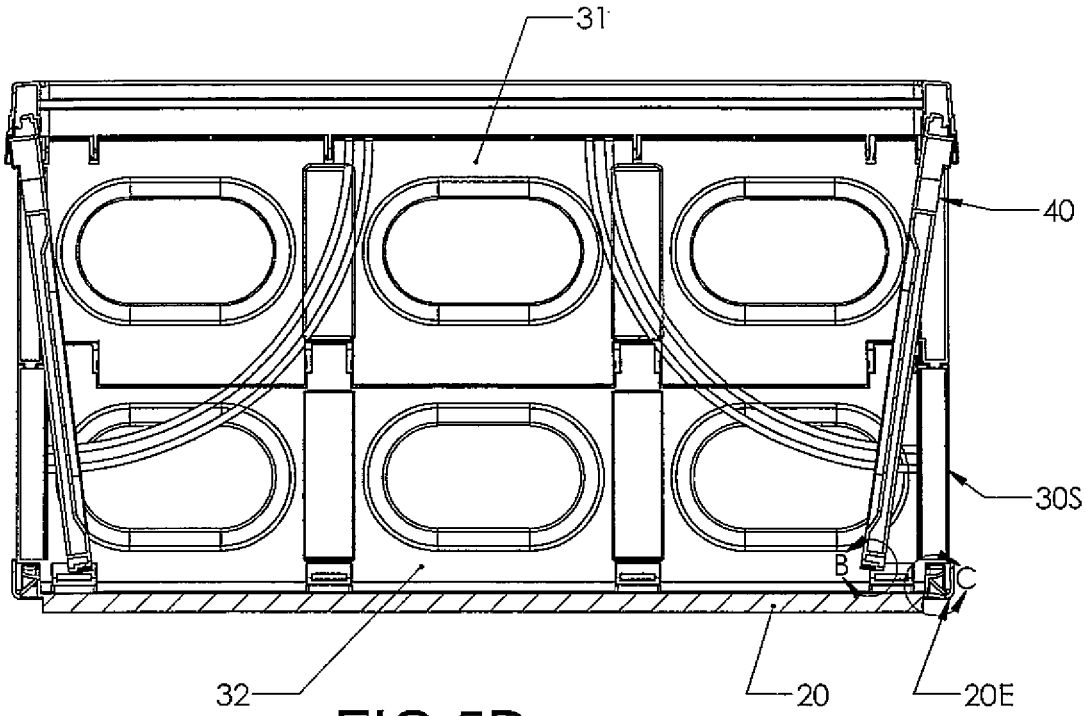
FIG. 5D is a side cross-sectional view of the crate of FIG. 5C, taken along line A-A.
Figure 5F:
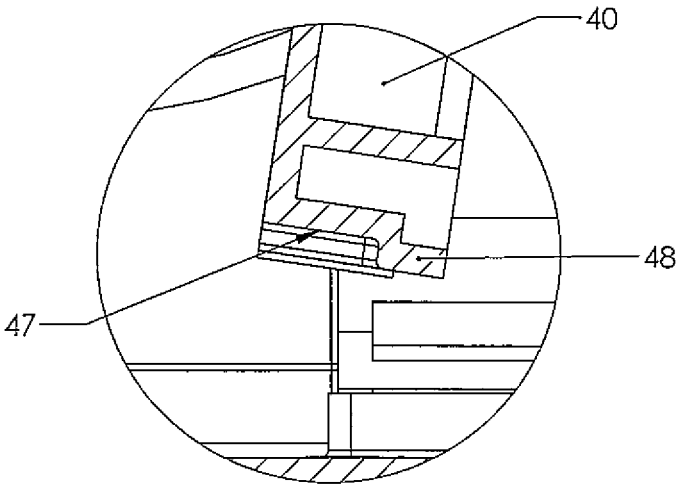
FIG. 5F is a detailed side cross-sectional view of a receiving notch of FIG. 5D, as shown in region B.

In one or more embodiments, a releasable catch 27 is formed between the lower end of the end wall 40 and the adjacent end edge 20E of the bottom member 20. In the illustrated embodiment, the catch 27 is formed in the end edge 20E of the bottom member 20 and extends upwardly as a nonlinear prong which is supported by a cross member 27X extending from wall 28 outwardly of the catch 27, as shown in FIGS. 5A, 5B and 5E. Correspondingly, a receiving recessed slot or notch 47 defined by a bottom portion 48 of the bottom member 20 is formed in the bottom edge 40B of the end wall 40, as shown in FIGS. 4B, 5C and 5F. The catch 27 is curved so that it can be wedged within the notch 47 and bias the end wall 40 to remain standing. A threshold inward force is thus applied by the user to release the catch 27 thereby allowing the end wall 40 to swing inwardly. In other words, the catch 27 and the notch 47 together may provide a releasable locking mechanism that prevent or limit the end wall 40 from swinging about the top end axes TE1 or TE2 when the crate is in the erect configuration without the application of a threshold force. Further, the wall 28 acts as a stop in resisting the end wall 40 from swinging outwardly past the wall 28 and destabilizing the crate in the erect configuration.

The releasable catch 27 is configured to flex when engaging and disengage with the notch 47. When the crate 100 is rearranged from the collapsed position to the erect position, the end wall 40 swings downwardly and the notch 27 slides over the catch 27 with the wall 28 stopping the end wall 40 from swinging outwardly past the wall 28. When the crate 100 is rearranged from the erect configuration to the collapsed configuration, the user applies a threshold inward force on the end wall 40 to push the bottom portion 48 over the catch 27 in releasing the end wall 40 to swing inwardly.

In some embodiments, the crate 100 may include more than one set of catch 27 and notch 47 for each end wall 40. In the illustrated embodiment, the one set of catch and notch is formed in a generally center location along the bottom edge of the end wall 40 and the bottom end edge 20B. It is understood that the arrangement of the catch 27 and notch 47 may be altered, for example, reversed where the catch 27 is formed on the end wall 40 and the notch 47 is formed on the bottom member 20.

In some embodiments, one or more alignment guide tabs 25 are provided between the bottom edge of each end wall 40 and the end edge 20E of the bottom member 20. In the illustrated embodiment of FIGS. 4A & 4B, the end edge 20B of the bottom member 20 includes one or more projecting tabs 25 extending inwardly, and the bottom edge of the end wall 40 includes one or more outwardly-facing slot openings 45 adapted to receive the tabs. Each tab 25 is configured to extend into a corresponding opening 45 to guide the end wall 40 as it approaches its standing position. It is understood that the arrangement of the tabs 25 and the openings 45 may be altered, for example, reversed where the tabs 25 are formed at the bottom edge of the end walls 40 and the openings 45 are formed at the end edge of the bottom member 20. It is understood that the tabs 25 received in the openings 45 also provide support and stability to the crate 100 when it is in the erect configuration.

Figure 6A:
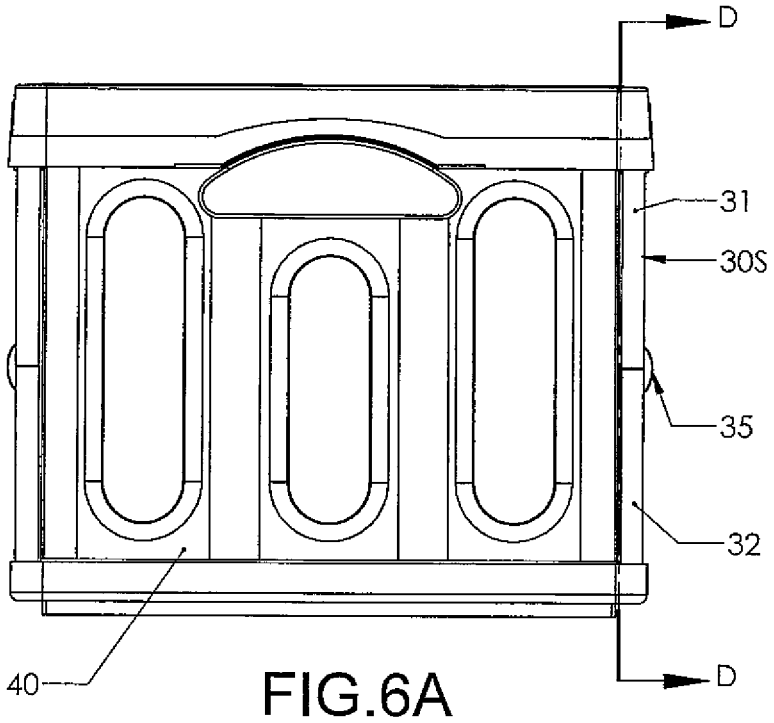
FIG. 6A is an end view of the crate of FIG. 1, with an end panel in the standing position.
Figure 6C:
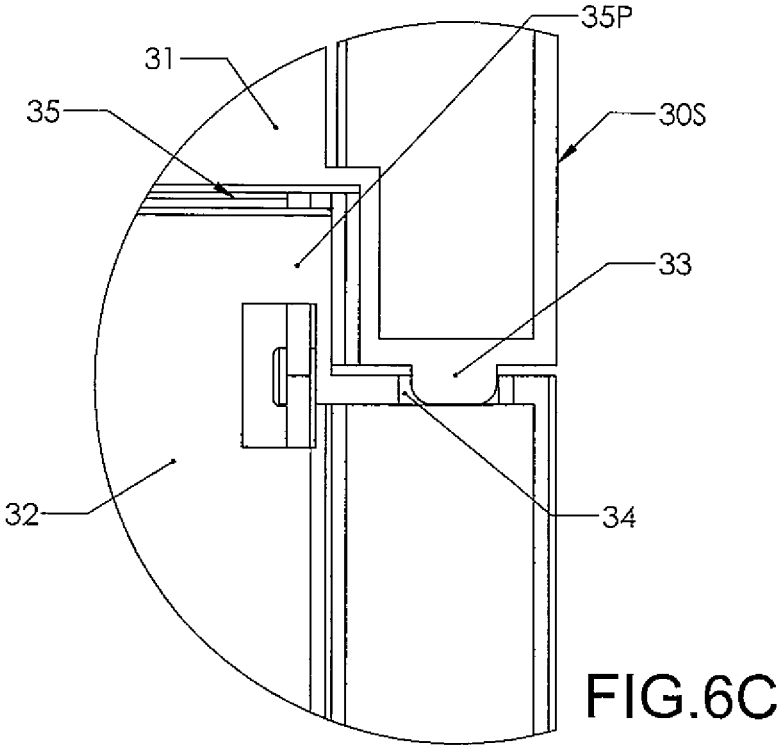
FIG. 6C is a detailed side view of a stop tab of FIG. 6B, as shown in region F.

In some embodiments, one or both side walls 30 include a stop tab 33 on their inner surfaces at a location along a junction between the upper and lower panels 31 and 32 which helps the hinge 35 resist from bowing outwardly and thus the side walls 30 from buckling outwardly. In the illustrated embodiment of FIGS. 6A and 6B, the stop tab 33 is formed in an edge section 30S of the side wall 30 as a downwardly-projecting formation from a lower edge of the upper panel 31, in the region of an interlocking projection 35P of the hinge 35. Correspondingly, an upwardly-facing receiving slot 34 for the stop tab 33 is formed in the edge section 30S of the side wall 30 in an upper edge of the lower panel 32. When the crate 100 is in the erect configuration, the tab 33 extends into the slot 34 and helps strengthen the hinge 35 from bowing outwardly thereby increasing load limits of the crate 100, in terms of ability to withstand vertical load stacked atop the crate and/or internal load carried in the crate. As shown in FIG. 8C, the stop tab 33 is generally flush with the inner surface 36 of the side wall 30 and does not interfere with movement of the end wall 40.

Figure 6B:
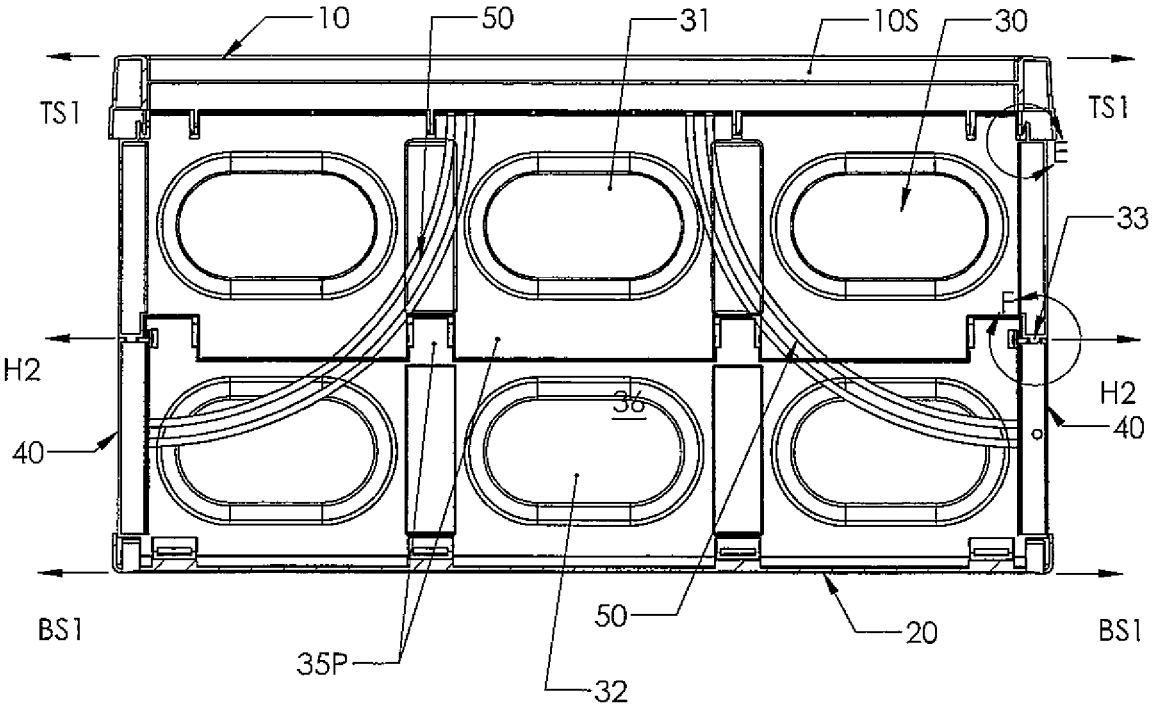
FIG. 6B is a side cross-sectional view of the crate of FIG. 6A, taken along line D-D.
Figure 6D:
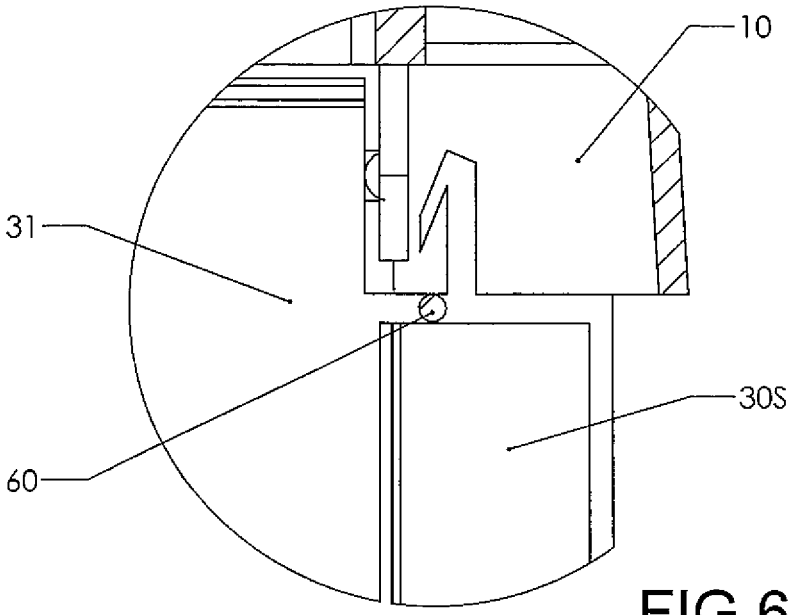
FIG. 6D is a detailed side view of a protrusion of FIG. 6B, as shown in region E.
Figure 7A:
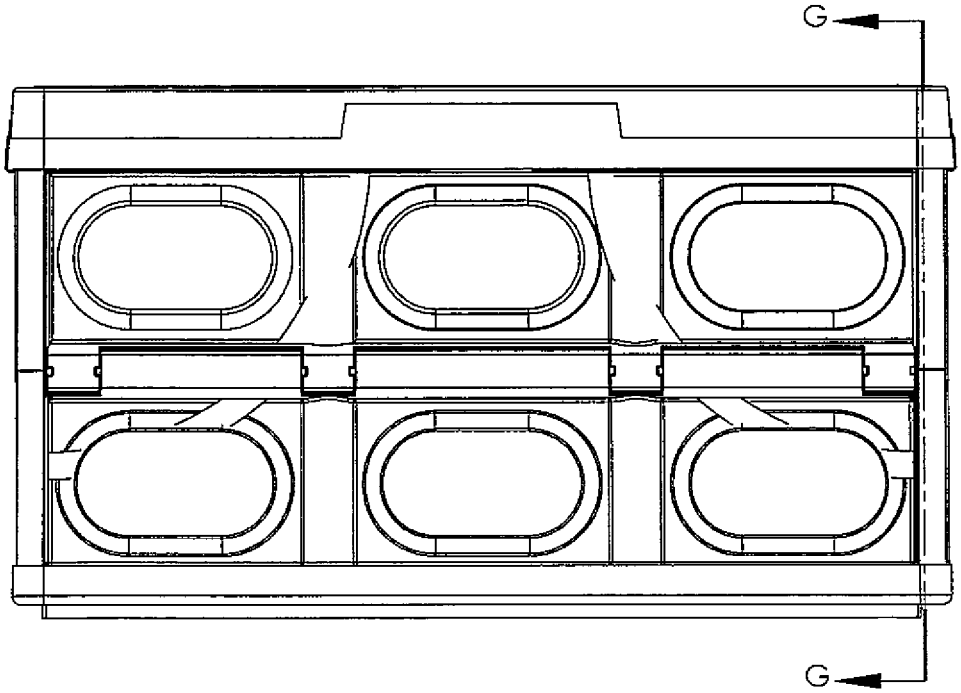
FIG. 7A is a side view of the crate of FIG. 1.
Figure 7B:
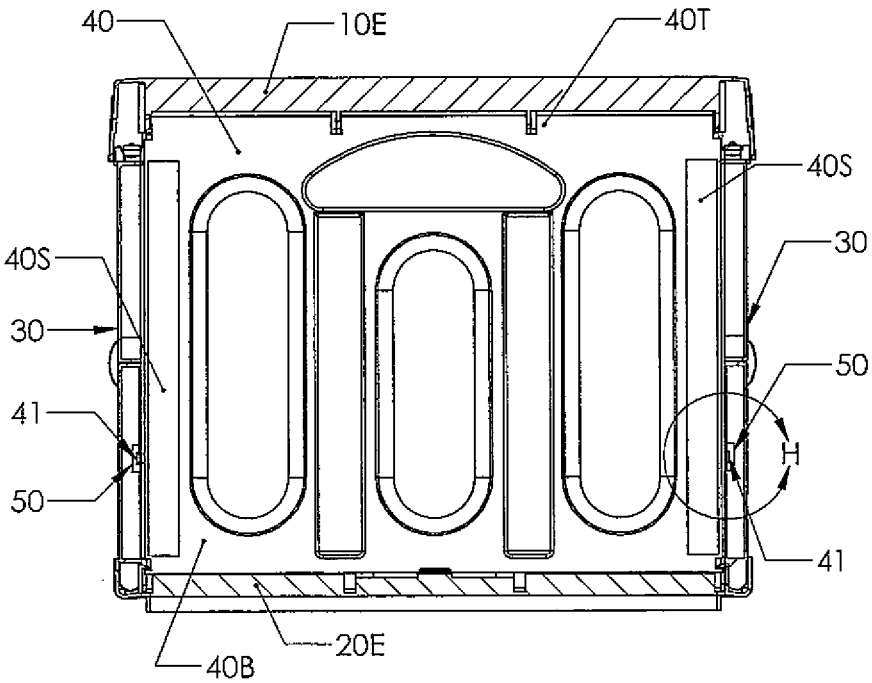
FIG. 7B is an end cross-sectional view of the crate of FIG. 7A, taken along line H-H.
Figure 7C:
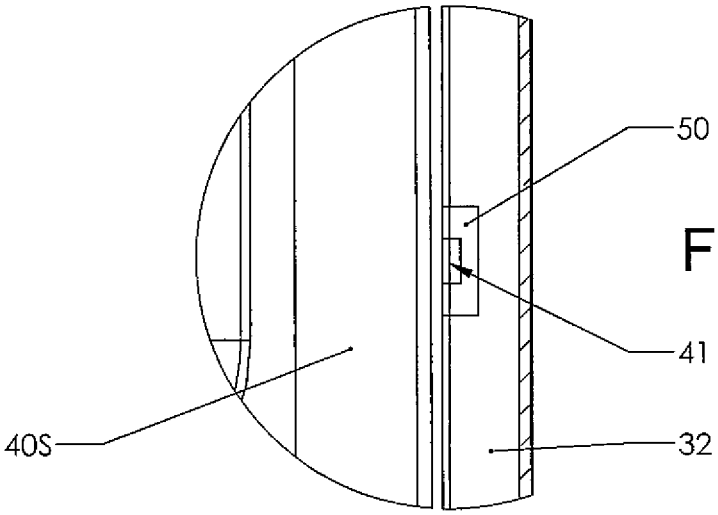
FIG. 7C is a detailed view of a pin engaged in a channel of FIG. 7B, as shown in region E.

In some embodiments, each side wall 30 on its inner surface 36 includes one or more nonlinear recessed formations or channels 50. As illustrated in FIG. 6B, each channel 50 traces an arcuate shape. As illustrated in FIGS. 7A, 7B and 7C, the end walls 40 include a raised formation or pin 41 formed at a side edge 40S of the end wall 40 in a direction parallel to the end axes TE1, BE1 or TE2, BE2. The channels 50 and the pins 41 facilitate movement of the end walls 40 when the crate is rearranged between the collapsed configuration and the erect configuration. The channel 50 and the pin 41 avoid damage, scraping or marring of the inner surface 36 of the side walls 30.

The pin 41 is configured to engage with the channel 50 and to move or slide within the channel 50 as the end wall 40 is pivoted about the top end axis TE1 or TE2. As such, the channel 50 and the corresponding pin 41 together facilitate movement of the corresponding end wall 40 as it is pivoted inwardly about the top end axis TE1 or TE2. Thus, the channel 50 and the pin 41 enhance durability of the crate 100, as the channel 50 and the pin 41 avoid damage, scraping or marring of the inner surface 36 of the side walls 30, and reduce the likelihood of the end wall 40 pivoting about the top end axes TE1 or TE2 at an abnormal angle.

Each end wall 40 may have a plurality of pins 41 along the side edges 40S with each corresponding to a respective channel 50 along the inner surface 36 of the side walls 30. Accordingly, the number of channels 50 and the number of pins 41 are generally equal. In the illustrated embodiment, one pin on each side edge 40S of the end wall 40 is located closer to the bottom end than the top end of the end wall 40, at a location corresponding generally to a mid-location along the side edge of the lower panel 32.

In the illustrated embodiment of FIG. 6B, each channel 50 extends through a portion of the upper panel 31 and a portion of the lower panel 32. It is understood that the arcuate pattern traced by the each channel can vary depending on the location of its respective pin 41 on the side edge 40S of the end wall 40. It is also understood that where each side edge 40S of an end wall 40 has more than one pin 41, as desired or appropriate, the corresponding inner surface 36 of the side wall 30 will have a corresponding number of channels 50. Moreover, depending on the relative sizes of the side walls 30 and end walls 40, and locations of the pins 41, different channels 50 may intersect each other.

In some embodiments, one or more side walls 30 provide at least one interference protrusion 60 on their inner surface 36 for engagement with an end wall 40. In the illustrated embodiment of FIGS. 6B, 6D, 8A and 8B, the interference protrusion 60 is located on a side edge 30S of the side wall 30, near an upper corner of the crate. The protrusion 60 is configured to abut a portion of the adjacent end wall 40 with an interference fit when the end wall is standing and the crate is in an erect configuration. The interference fit requires the user to apply a threshold inward force to release the end wall 40 from its standing position, thus minimizing the risk of the crate 100 accidentally collapsing. In other words, the protrusion 60 is configured to releasably maintain the end wall 40 in the standing position when the crate 100 is in the erect configuration.

Figure 8A:
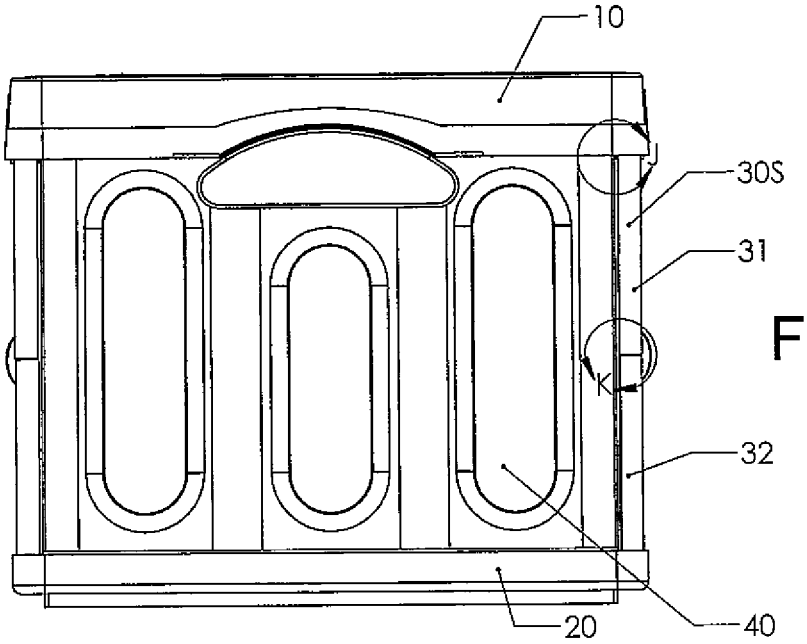
FIG. 8A is an end view of the crate of FIG. 1.
Figure 8C:
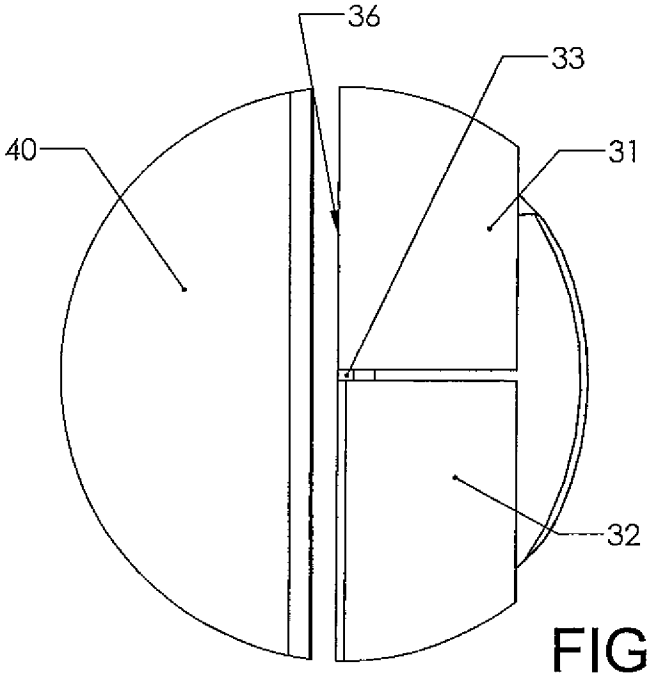
FIG. 8C is a detailed end view of a stop tab of FIG. 8A, as shown in region K.
Figure 8B:
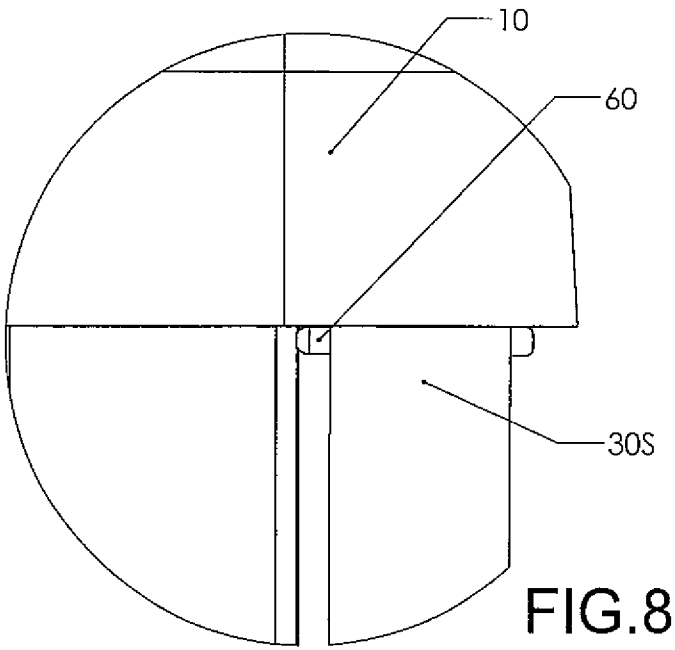
FIG. 8B is a detailed end view of a protrusion of FIG. 8A, as shown in the region J.
Figure 9A:
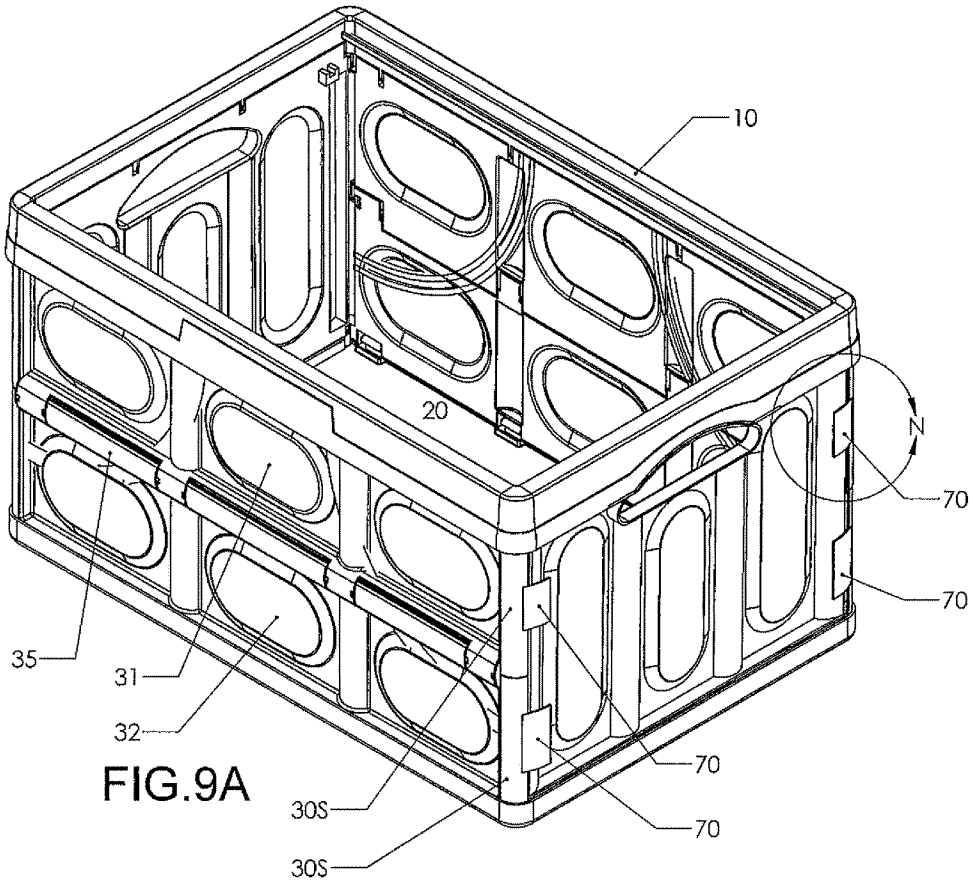
FIG. 9A is a perspective view of a crate of the present disclosure, in accordance with another embodiment.
Figure 9C:
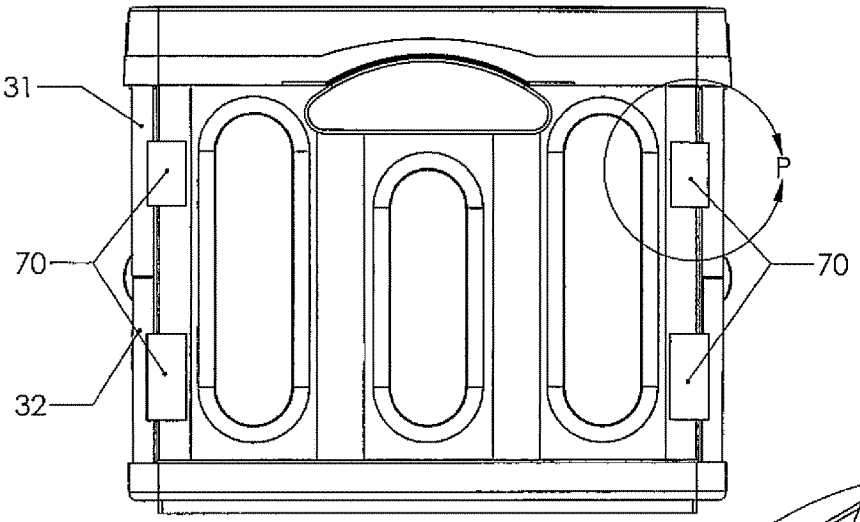
FIG. 9C is an end view of the craft of FIG. 9A.
Figure 9B:
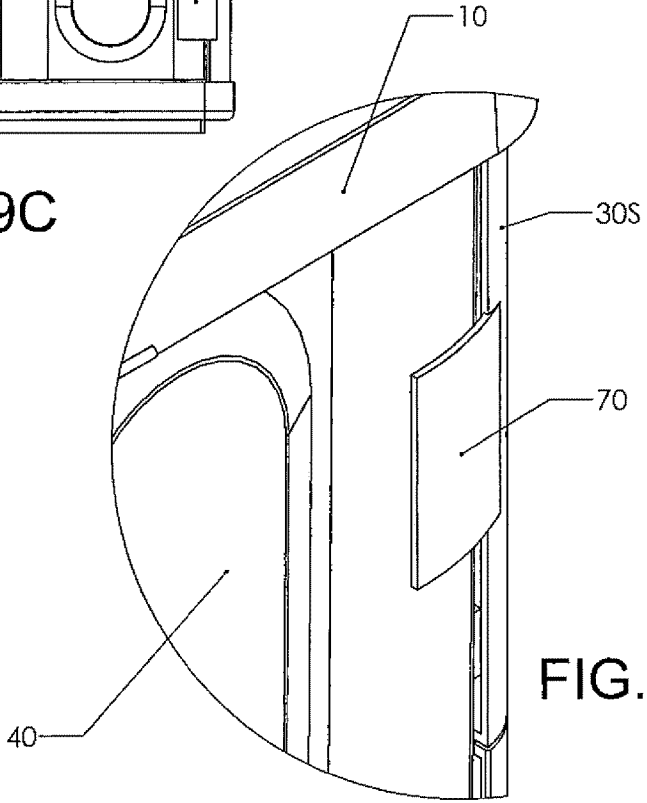
FIG. 9B is a detailed perspective view of a flange of FIG. 9A, as shown in region M.
Figure 9D:
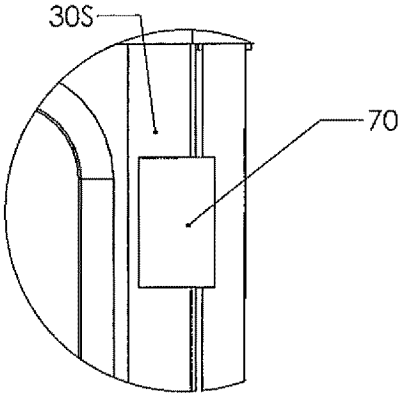
FIG. 9D is a detailed end view of a flange of FIG. 9C, as shown in region P.

In the illustrated embodiment of FIG. 8A and 8B, the protrusion 60 is formed at the side edge 30S and near the top edge 30T of the side wall 30 (e.g., may protrude inwardly from the upper panel 31 at an upper portion of the upper panel 31). However, the present disclosure is not limited thereto. For example, the protrusion 60 may be formed near a bottom edge 30B, or may be formed near the hinge 35, or may be formed at any suitable position along the side edge 30S. In other embodiments, the protrusion 60 is formed on the end edge 20E of the bottom member 20 and protrudes upwardly from the side edge 20S of the bottom member 20 or near a corner of the bottom member 20. For example, the protrusion 60 may be formed near the bottom end edge 20E and the bottom side edge 20S of the bottom member 20. Where there is more than one protrusion 60, a user may need to apply the threshold force at different locations on the end walls 40 to overcome the protrusions 60 and collapse the crate 100. The protrusion 60 may have any suitable cross-sectional shape, for example, circular, rectangular or any other suitable shape.

In one or more embodiments, the side wall 30 includes one or more flanges 70 configured to increase stability of the crate in the erect configuration and to enhance load limits of the crate 100 in terms of its vertical load and internal carrying load capabilities. The one or more flanges 70 serve to contain the end panels 40 prevent them from swinging outwardly and destabilizing the crate. In the illustrated embodiment of FIGS. 9A, 9B, 9C and 9D, each flange 70 extends from the side edge 30S of a side wall 30 toward the opposing side wall or in a direction generally parallel to the end axes BE1 and TE1 or BE2 and TE2. In some embodiments, the flange 70 is formed on the upper panel 31 spaced apart from the hinge 35 in the vertical direction. As such, the flange 70 extends from the upper panel 31 on an upper portion of the upper panel 31. In one or more embodiments, the flange 70 is formed on the lower panel 32 and is spaced apart from the hinge 35 in the vertical direction. As such, the flange 70 extends from the lower panel 32 on a lower portion of the lower panel 32.

In one or more embodiments, the side wall 30 includes a plurality of flanges 70. For example, a side wall 30 may include a pair of flanges 70 formed at opposite side edges 30S of the side wall 30, such that one flange 70 is adjacent one end wall 40, and another flange 70 is adjacent the other end wall 40 when the crate 100 is in the erect configuration. The number of flanges any side edge 30S may have can be varied as appropriate or desired.

Figure 10A:
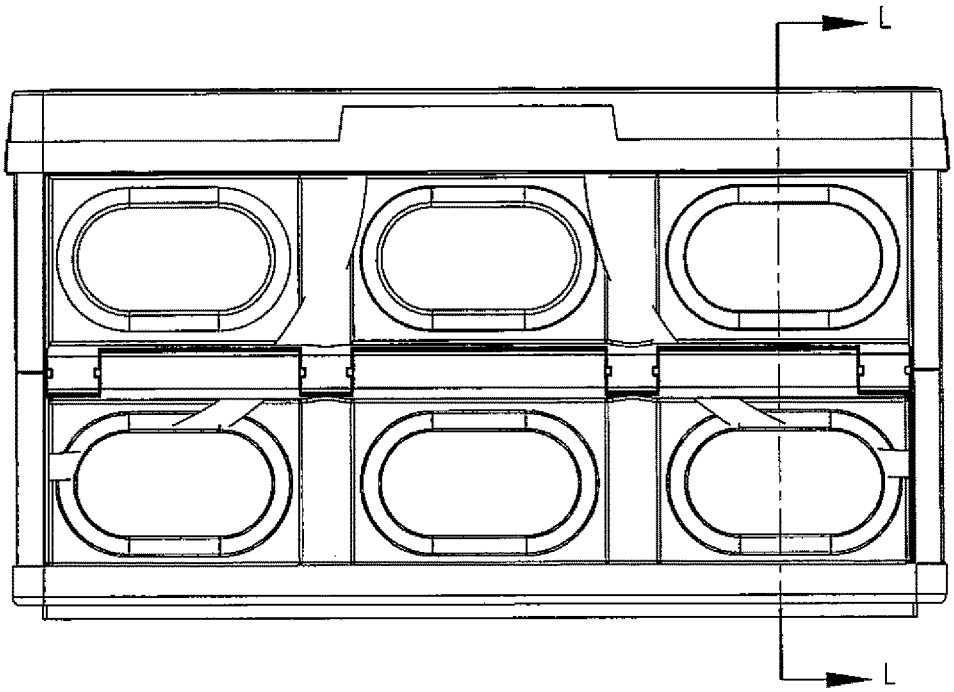
FIG. 10A is a side view of a crate of the present disclosure, in accordance with another embodiment.
Figure 10B:
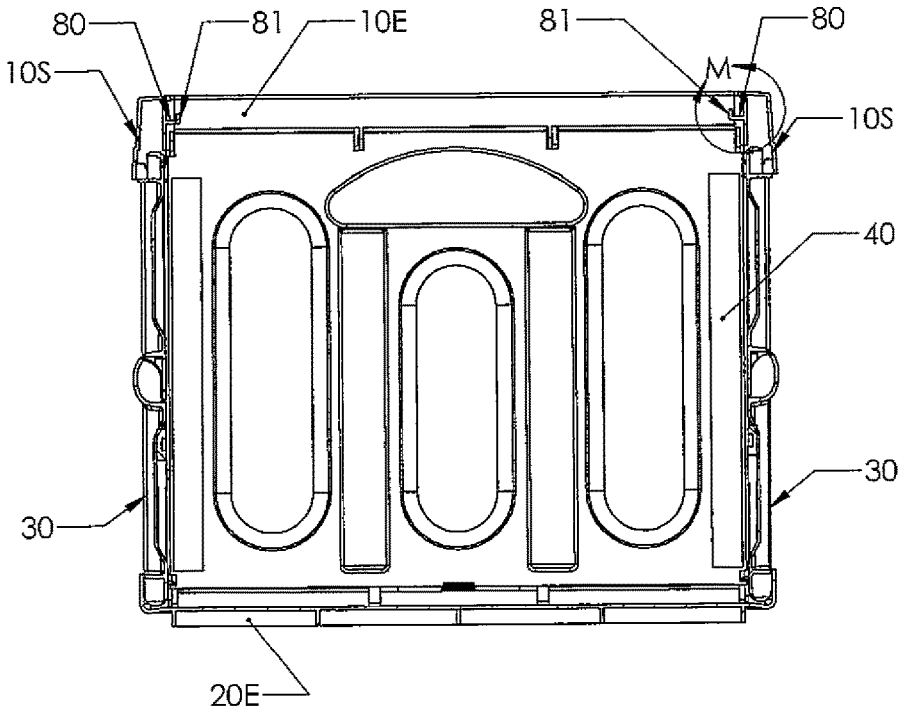
FIG. 10B is an end cross-sectional view of the crate of FIG. 10A, taken along line L-L.

In one or more embodiments, the crate 100 is configured to accommodate one or more hanging file folders. In the illustrated embodiment of FIGS. 10A, 10B and 10C, an elongated groove or rail 80 is formed in the inner surface of opposing top side sections 10S of the top 10. The file rails 80 each include a lip 81 that extends from the rails 80 in the vertical direction to help retain end hooks of a hanging file folder from disengaging the rail 80. A pair of rails 80 may be formed in opposing top side sections 10S and/or opposing top end section 10E, as desired or appropriate. The rails 80 may also be formed in the inner surface 36 of the side walls 30 and/or the end walls 40, as desired or appropriate, below the top member 10, at a suitable height.

In one or more embodiments, the crate includes brackets 90 formed in the inner surface of top member 10, the side walls 30 and/or the end walls 40, at a suitable height for supporting ends of elongated members, e.g., rods or bars, on which hooks of hanging file folder are suspended or supported. The support 90 may be any suitable shape, for example, substantially U-shaped, as shown in FIG. 11. In one or more embodiments, at least four brackets are provided to support a pair of elongated members.

Whether hanging file folders are supported directly by the rails 80 or indirectly by the brackets 90, heavy files hung in the hanging file folders can also pose a significant load on the crate 100. Advantageously, one or more of the aforementioned features improve stability of the crate to remain erect and not collapse from the load.

Figure 12:
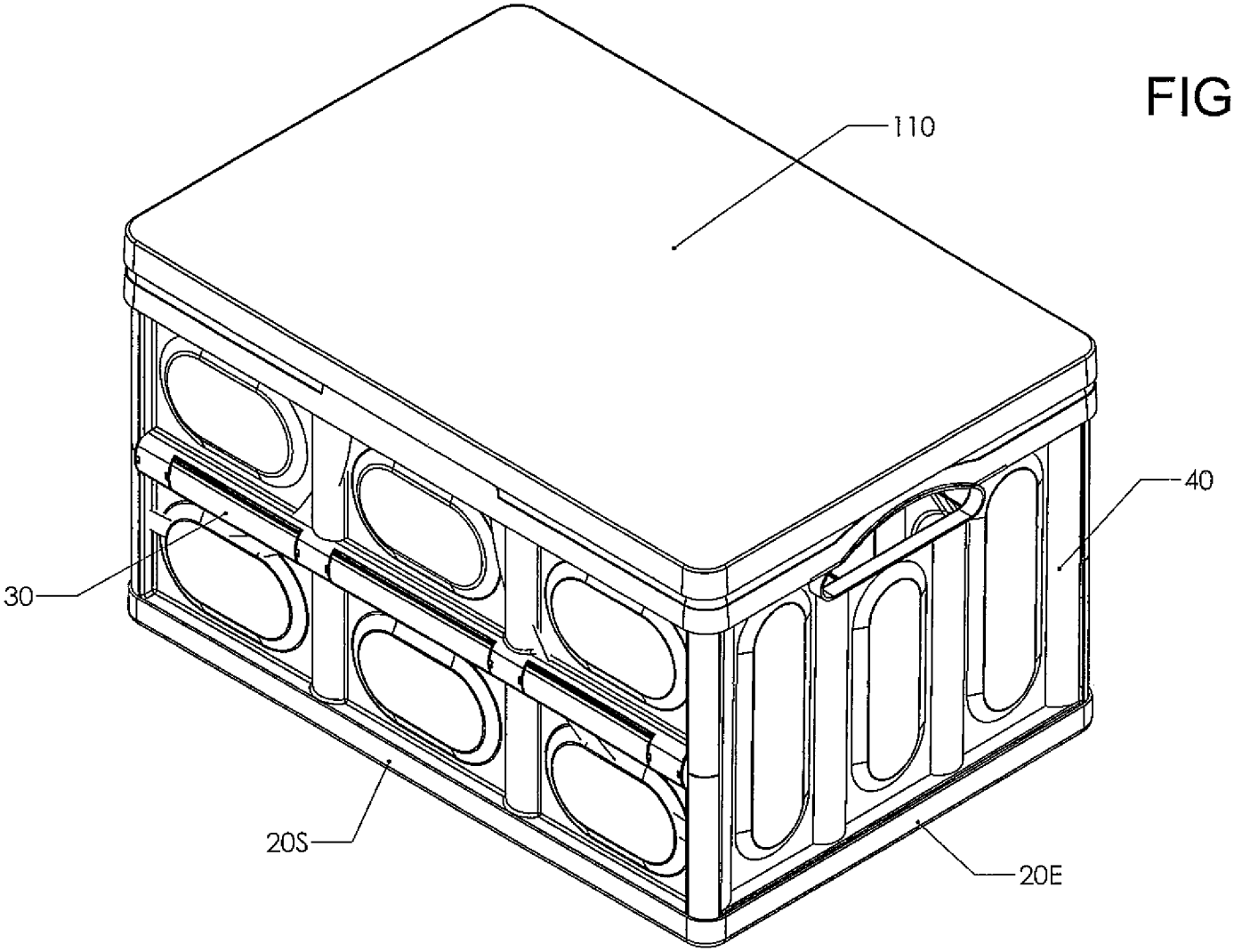
FIG. 12 is a perspective view of a crate of the present disclosure, with a lid, in accordance with an embodiment.

As shown in FIG. 12, in one or more embodiments, the crate 100 includes a detachable or removable lid 110. The lid 110 may be attachable and detachable to the top 10. The lid 110 may be attachable to the crate 100 when it is in the collapsed configuration and when it is in the erect configuration, or any intermediate, orientation.

It will be understood by persons skilled in the art that any of the features described herein may be used alone or in combination and in addition to or in lieu of any other features described herein, as desired or appropriate, and still remain within the spirit and scope of the present disclosure.

While this disclosure has been described in detail with particular references to some exemplary embodiments thereof, the exemplary embodiments described herein are not intended to be exhaustive or to limit the scope of the disclosure to the exact forms disclosed. It is understood that the drawings are not necessarily to scale. Persons skilled in the art and technology to which this disclosure pertains will appreciate that alterations and changes in the described structures and methods of assembly and operation can be practiced without meaningfully departing from the principles, spirit, and scope of this disclosure, as set forth in the following claims and their equivalents.

What is claimed is:

1. A collapsible crate movable between an erect configuration and a collapsed configuration, comprising:

a top member having two opposing top side sections and two opposing top end sections;

a bottom member having two opposing bottom side edges and two opposing bottom end edges;

first and second opposing end walls, the first and second end walls each being pivotably connected to the top along the corresponding top end sections;

first and second opposing side walls;

at least a first protrusion protruding from an inner surface of the first side wall, an inner surface of the first protrusion facing away from the inner surface of the first side wall and being configured to abut an outer surface of the first end wall facing the inner surface of the first side wall with an interference fit when the crate is in the erect configuration;

a releasable catch on one of the two opposing bottom end edges of the bottom member, the releasable catch comprising an upwardly curved prong; and a receiving notch in a bottom edge of one of the first and second opposing end walls, wherein, when the collapsible crate is in the erect configuration, the upwardly curved prong is wedged in the receiving notch and the upwardly curved prong biases the collapsible crate to remain in the erect configuration, and wherein, when the collapsible crate is in the erect configuration, the interference fit between the first protrusion and the first end wall releasably maintains the collapsible crate in the erect configuration and creates a frictional force that must be overcome by a threshold inward force to move the collapsible crate into the collapsed configuration, and wherein the first protrusion is proximate to a top edge of the first end wall opposite to the bottom edge of the first end wall including the receiving notch.

2. The collapsible crate of claim 1, further comprising at least an alignment tab configured between the bottom edge of the one of the first and second opposing end walls and the one of the two opposing bottom end edges of the bottom member.

3. The collapsible crate of claim 1, further comprising at least a stop tab and a receiving slot on a side wall, one of the stop tab and the receiving slot being formed in an upper panel of the side wall and the other of the stop tab and the receiving slot being formed in a lower panel of the side wall.

4. The collapsible crate of claim 1, further comprising at least a flange extending from a side wall to contact an adjacent end wall.

5. The collapsible crate of claim 1, further comprising at least a channel formed on an inner surface of a side wall, and a pin formed on a side edge of an adjacent end wall, wherein the pin is configured to move along in the channel as the crate is reconfigured between the erect configuration and the collapsed configuration.

6. The collapsible crate of claim 1, further comprising a rail formation in each of opposing first and second side walls.

7. The collapsible crate of claim 1, further comprising a rail formation in each of opposing first and second end walls.

8. The collapsible crate of claim 1, further comprising a bracket on each of opposing first and second side walls.

9. The collapsible crate of claim 1, further comprising a bracket on each of opposing first and second end walls.

10. The collapsible crate of claim 1, wherein the first and second side walls each comprise:

an upper panel with a first set of interlocking projections along a lower edge of the upper panel; and a lower panel with a second set of interlocking projections along an upper edge of the lower panel, wherein the first and second sets of interlocking projections are configured to pivotally connected the upper and lower panel.

11. The collapsible crate of claim 5, wherein the first side wall comprises a first channel and wherein the first end wall comprises a first pin extending from a side edge of the first end wall in a direction parallel to the end axes and configured to move within the first channel.

12. The collapsible crate of claim 5, wherein the channel has an arcuate shape.

13. A collapsible crate movable between an erect configuration and a collapsed configuration, comprising:

a top member having two opposing top side sections;

a bottom member having two opposing bottom side edges;

first and second opposing end walls, the first and second end walls each being hingedly connected to the top member along the corresponding top end sections;

first and second opposing side walls, each side wall having an upper panel and a lower panel, a top edge of the upper panel being hingedly connected to the top member, a bottom edge of the lower panel being hingedly connected to the bottom member, a bottom edge of the upper panel and an upper edge of the lower panel being hingedly connected to each other;

at least a first protrusion protruding from an inner surface of the first side wall, an inner surface of the first protrusion facing away from the inner surface of the first side wall and being configured to abut an outer surface of the first end wall facing the inner surface of the first side wall with an interference fit when the crate is in the erect configuration;

at least one releasable catch configured between a bottom edge of an end wall and an adjacent end edge of the bottom member, the releasable catch comprising an upwardly curved prong;

a receiving notch in one of the bottom edge of the end wall and the adjacent end edge of the bottom member; and at least an alignment tab configured between a bottom edge of an end wall and an adjacent end edge of the bottom member, wherein, when the collapsible crate is in the erect configuration, the upwardly curved prong is wedged in the receiving notch and the upwardly curved prong biases the collapsible crate to remain in the erect configuration, and wherein, when the collapsible crate is in the erect configuration, the interference fits between the first protrusion and the first end wall releasably maintains the collapsible crate in the erect configuration and creates a frictional force that must be overcome by a threshold inward force on the first end wall to move the collapsible crate into the collapsed configuration, and wherein the first protrusion is proximate to a top edge of the first end wall opposite to the bottom edge of the first end wall including the receiving notch.

* * * * *